US012055361B2

(12) United States Patent
Fester et al.

(10) Patent No.: US 12,055,361 B2
(45) Date of Patent: Aug. 6, 2024

(54) HOUSING SECTION FOR A CARTRIDGE MAGAZINE FOR A PORTABLE FIREARM, CARTRIDGE MAGAZINE WITH HOUSING SECTION, CONVERSION KIT, METHOD FOR CONVERSION OF A CARTRIDGE MAGAZINE, AND METHOD FOR OPERATING A PORTABLE FIREARM

(71) Applicant: Schmeisser GmbH, Krefeld (DE)

(72) Inventors: Eugen Fester, Lohne (DE); Thomas Hoff, Krefeld (DE); Simon Peschlow, Kempen-Tönisberg (DE); Andreas Schumacher, Krefeld (DE)

(73) Assignee: Schmeisser GmbH, Krefeld (DE)

( * ) Notice: Subject to any disclaimer, the term of this patent is extended or adjusted under 35 U.S.C. 154(b) by 41 days.

(21) Appl. No.: 17/949,784

(22) Filed: Sep. 21, 2022

(65) Prior Publication Data

US 2023/0087597 A1 Mar. 23, 2023

(30) Foreign Application Priority Data

Sep. 22, 2021 (DE) ..... 10 2021 004 782.6

(51) Int. Cl.
*F41A 9/71* (2006.01)
*F41A 9/69* (2006.01)

(52) U.S. Cl.
CPC . *F41A 9/71* (2013.01); *F41A 9/69* (2013.01)

(58) Field of Classification Search
CPC ..... F41A 9/64–71
See application file for complete search history.

(56) References Cited

U.S. PATENT DOCUMENTS 4,332,097 A 6/1982 Taylor, Jr.
4,689,907 A * 9/1987 Gwinn, Jr. ..... F41A 9/73 89/33.02

(Continued)

FOREIGN PATENT DOCUMENTS

CN 102906530 A * 1/2013 ..... F41A 9/61
CN 102906531 A * 1/2013 ..... F41A 9/61

(Continued)

OTHER PUBLICATIONS

German Office Action dated Feb. 23, 2022 for German Patent Application No. 10 2021 004 782.6 (9 pages).

(Continued)

*Primary Examiner* — Jonathan C Weber
(74) *Attorney, Agent, or Firm* — Taylor IP, P.C.

(57) ABSTRACT

A housing section for a cartridge magazine for a portable firearm, the housing section including: a housing section shell including an inside shell surface, an outside shell surface, and an interior space which forms a first region and a second region; a housing section top side having a first opening cross section; a housing section bottom side having a second opening cross section; a first cross section forming the first region and being configured for accommodating a first number of rows of a plurality of cartridges arranged next to one another; and a second cross section forming the second region and being configured for accommodating a second number of rows of the plurality of cartridges arranged side-by-side, the second number and the first number differing from one another by at least one full numerical value, the first cross section being consistent with the first opening cross section.

15 Claims, 9 Drawing Sheets

(56) References Cited

U.S. PATENT DOCUMENTS

| | | | | |
|---|---|---|---|---|
| 8,572,877 | B2 * | 11/2013 | Sullivan | F41A 9/69 42/50 |
| 8,607,489 | B1 | 12/2013 | Calvert | |
| 8,739,446 | B2 * | 6/2014 | Sullivan | F41A 9/69 42/50 |
| 8,844,183 | B2 * | 9/2014 | Sullivan | F41A 9/70 42/50 |
| 8,887,428 | B1 * | 11/2014 | Lemoine | F41A 9/63 42/49.02 |
| 8,966,801 | B1 | 3/2015 | Bentley | |
| 9,528,784 | B2 * | 12/2016 | Roberts | F41A 9/70 |
| D853,520 | S | 7/2019 | Cheng | |
| D869,595 | S | 12/2019 | Cheng et al. | |
| 10,852,086 | B1 | 12/2020 | Hillis et al. | |
| 10,866,045 | B2 * | 12/2020 | Schumacher | F41A 9/68 |
| 2012/0131831 | A1 * | 5/2012 | Sullivan | F41A 9/65 42/50 |
| 2012/0167429 | A1 * | 7/2012 | Sullivan | F41A 9/69 42/50 |
| 2013/0255125 | A1 | 10/2013 | Bath | |
| 2014/0053446 | A1 * | 2/2014 | Sullivan | F41A 9/69 42/50 |
| 2015/0308766 | A1 * | 10/2015 | Bentley | F41A 9/71 42/50 |
| 2016/0327353 | A1 * | 11/2016 | DiChario | F41A 9/70 |
| 2016/0327354 | A1 * | 11/2016 | DiChario | F41A 9/62 |
| 2017/0321979 | A1 | 11/2017 | Szczepkowski et al. | |
| 2018/0364003 | A1 * | 12/2018 | Henderson | F41A 9/65 |
| 2019/0310040 | A1 * | 10/2019 | Ladner | F41A 9/62 |
| 2022/0107149 | A1 * | 4/2022 | Ladner | F41A 9/70 |

FOREIGN PATENT DOCUMENTS

| | | | | |
|---|---|---|---|---|
| DE | 10 2018 000 740 | A1 | 8/2019 | |
| DE | 202018005590 | U1 * | 8/2019 | |
| DE | 10 2019 000 388 | A1 | 7/2020 | |
| DE | 102020000298 | A1 * | 7/2021 | E05C 17/08 |
| RU | 2683921 | C1 * | 4/2019 | |
| WO | WO-2011159383 | A2 * | 12/2011 | F41A 9/61 |
| WO | WO-2012003020 | A2 * | 1/2012 | F41A 9/61 |
| WO | 2017/106928 | A1 | 6/2017 | |
| WO | WO-2019207328 | A1 * | 10/2019 | |
| WO | WO-2021148234 | A1 * | 7/2021 | |

OTHER PUBLICATIONS

Kriss MagEx2 Extended Magazine, taken from https://store.kriss-usa.com/kriss-mag-ex2-extended-magazine/ (4 pages).

* cited by examiner

HOUSING SECTION FOR A CARTRIDGE MAGAZINE FOR A PORTABLE FIREARM, CARTRIDGE MAGAZINE WITH HOUSING SECTION, CONVERSION KIT, METHOD FOR CONVERSION OF A CARTRIDGE MAGAZINE, AND METHOD FOR OPERATING A PORTABLE FIREARM

CROSS REFERENCE TO RELATED APPLICATIONS

This claims priority to German patent application no. 10 2021 004 782.6, filed Sep. 22, 2021, which is incorporated herein by reference.

BACKGROUND OF THE INVENTION

1. Field of the Invention

The present invention relates to a housing section for a cartridge magazine for a portable firearm, wherein the housing section is defined by a housing section shell, extending along an X-axis, a Y-axis and a Z-axis, wherein the housing section shell has an inside shell surface and an outside shell surface and in its interior includes an interior space that is limited by the inside shell surface, and wherein the interior space forms at least a first region and a second region, wherein the housing section includes a housing section top side and a housing section bottom side, wherein the housing section top side has a first opening cross section and the housing section bottom side has a second opening cross section.

The present invention moreover relates to a cartridge magazine for a portable firearm, wherein the cartridge magazine includes: a housing for a cartridge magazine for a portable firearm which is defined by a housing shell, extending along an X-axis, a Y-axis and a Z-axis, wherein the housing shell has an inside housing shell surface and an outside housing shell surface and in its interior includes an interior housing space that is limited by the inside housing shell surface, and wherein the interior housing space forms at least a first region and a second region, wherein the housing includes a housing top side and a housing bottom side, wherein on the top side of the housing magazine lips are formed, wherein the housing bottom side has a base opening cross section, wherein a base locking section adjoins the base opening cross-section in Z-direction on the bottom side of the housing and/or surrounds the base opening cross-section on the outside at least in X-direction and/or Y-direction, and wherein the base locking section is suitable for releasably locking a housing section for a cartridge magazine for a portable firearm and/or a base cover, wherein the cartridge magazine further includes at least one feeder, at least one feeder spring and one base cover.

The present invention further relates to a conversion kit and to a method for converting a cartridge magazine for a portable firearm.

Ultimately, the present invention also relates to a method for operating a portable firearm by using a cartridge magazine.

2. Description of the Related Art

Cartridge magazines for portable firearms have been known for a long time and are manufactured according to the state of the art in different designs. The expert distinguishes hereby between cartridge magazines firmly connected to the portable firearm and those that are quickly and repeatedly connectable to the portable firearm by releasing a holding mechanism. Fixed magazines generally offer the advantage of being captive, but also the disadvantage that reloading is quite time-consuming. Generally, the cartridges must be inserted individually via the magazine lips of the fixed magazine, regardless of whether the fixed magazine is designed in the form of a box, in which the cartridges to be accommodated are stored in such a way that the cartridge shell surfaces touch each other, or whether it is designed in the form of a tubular magazine, in which the cartridges to be accommodated touch each other at their front and rear end surfaces. Rapid loading systems, such as loading clips or tubes are known for both variants, however, they are only moderately practical and have therefore been irrelevant in official use for many decades.

Changeable cartridge magazines, which are also referred to as cartridge plug-in magazines, drum magazines and stack-type magazines are most commonly known. Stack-type magazines are basically divided into linear row magazines, which are also referred to as bar magazines, and arc-shaped row magazines. In stack-type magazines, the cartridges are stored in such a way that, when the cartridge magazine is at least partially full, they touch each other tangentially at their shell walls inside the cartridge magazine housing. Depending on whether the stack-type magazine is of single-row or multi-row design and depending on whether it is of a linear or a curved design, the contact points or the contact lines of the cartridges shift tangentially and/or axially with respect to one another, whereby the type and degree of the shift can also be strongly dependent on the fill level of the cartridge magazine, which may also change at high frequency in discrete steps during operation.

In particular for use by authorities, but also for sporting applications it is often desirable to equip a portable firearm with a suitable cartridge magazine that provides high fire power. This is understood to be the ability to fire a high number of shots within a short time. Since the exchange of a cartridge magazine—depending on the design of the retaining mechanism and the skill of the operator—requires a certain time, for example 2 to 4 seconds, the endeavor is to make the holding capacity of an individual cartridge magazine as large as possible.

In contrast thereto however is the manageability of the cartridge magazine for the operator who may need to carry the cartridge magazine apart from the portable firearm—as a spare magazine—which must also be designed to be manageable for the operator, even in stress situations and which does not reduce the manageability of the portable firearm with inserted cartridge magazine, or at least reduces it only to the least possible degree.

However, also an inserted cartridge magazine can significantly reduce the manageability of the portable firearm. For both reasons, drum magazines are thus only used to a limited extent, both in the civilian and in the official sector, and there mostly only in military use, for example when operating firearms mounted at least temporarily on vehicles, where they form the link to belt-fed firearms, which can then generally no longer be considered as hand-operated "portable firearms".

Portable firearms are understood to be long and short weapons that can be carried and operated by hand. For operation with a cartridge magazine, repeater pistols and self-loading pistols are known to be among short weapons. Today, almost only self-loading pistols play a role in a market analysis. Also in the case of long weapons, repeater rifles and self-loading rifles are known that are designed for operation with cartridge plug-in magazines.

The desire for the highest possible magazine capacity to provide the highest possible firepower is however paramount for long weapons as it is for short weapons for the models that feature a self-loading mechanism.

Cartridge magazines are model-specific. A handgun that has been in use by authorities worldwide for several decades is a self-loading rifle according to type AR-15/AR-16. For a repeatable, detachable connection of cartridge plug-in magazines with the portable firearm, this type of weapon has a downwardly open magazine shaft in which suitable cartridge magazines can be inserted. For this purpose, cartridge magazines with different capacities are known. For the operation of this weapons model, or another, generic portable firearm, magazines holding 20 or 30 cartridges are generally used today. A generic portable firearm is understood to be a self-loading rifle that offers the operator a choice between a first mode in which the weapon can be operated in such a way that a single shot is always triggered by the one-time operation of its trigger and a second mode in which the weapon can be operated in such a way that a plurality of shots is always triggered by the one-time operation of its trigger. In connection with the present description, the generic similarity of the described portable firearm should also be preserved if the operator can additionally choose between the delivery of a closed group of shots, for example 3- or 5-shot bursts of fire or a continuous fire when selecting a plurality of shots to be fired.

How fast successively the shots are delivered by the handgun after a single activation of the trigger when selecting an automatic sequence is referred to as rate of fire. The rate of fire of current standard handguns of the type described is usually between 600 shots per minute and approximately 1200 shots per minute.

On the basis of an average rate of fire of 900 shots per minute, a 20 shot magazine will be emptied in 1.33 seconds. In contrast, a 30 shot magazine holds exactly 2 seconds. If one assumes that a magazine change can be performed in 3 seconds, even under operating conditions, the handgun achieves an operating efficiency of approximately 40%. In comparison, with a 60 shot magazine under otherwise the same conditions it achieves an operating efficiency of approximately 58% and thus experiences an increase of almost 50%.

Unfortunately, for various reasons, the knowledge gained from the manufacture of cartridge magazines with a 20 or 30 shot capacity can be transferred only to a very limited degree to the manufacture of such high capacity magazines, for example 60 shot magazines.

Nevertheless, a highly functional high-capacity magazine has become known from DE 10 2018 000 740 B 1, which is already being used very successfully on the market, for example as a variant holding 60 cartridges.

If, on the other hand, one takes a closer look at the situation with short weapons, there is a surprisingly large shift in priorities in terms of quality and quantity.

Short weapons in contrast to long weapons—in this context especially self-loading pistols that can be operated with cartridge magazines—are predominantly carried concealed. Consequently, there is a high level of interest in regard to compact dimensions of the self-loading pistol. Since most self-loading pistols are designed to hold the cartridge magazine in the grip area, the maximum capacity of the respective cartridge magazine is then usually determined by the length of the grip area and is often also limited thereby.

Moreover, since the capacity of cartridge magazines for short weapons is on average significantly smaller than that of cartridge magazines for long weapons, and the cartridge magazines here can often only hold between 7 and 15 cartridges, it is common for a user, for example a police officer, to carry one or two additional cartridge magazines. As a rule, these cartridge magazines should also be inconspicuous, in other words concealed, wearable on the body, or at least easy to handle.

Since, generally, sport shooters operate their weapon, for example their self-loading pistol, most frequently and most distinctively, they usually own a variety of additional cartridge magazines for the different self-loading pistol models they use.

The model-specific cartridge magazines that are available in addition to a particular self-loading pistol are also referred to in specialist circles as interchangeable magazines.

Such interchangeable magazines are sometimes a little longer, for example to hold one or two more cartridges.

For manufacturing reasons, such cartridge magazines have been manufactured for about 60 to 80 years, usually using an extension unit often referred to as a "magazine shoe".

Such magazine shoes are commonly known from the current state of the art.

Arrangements have also become known which are optionally designed to be interchangeable with the base cover of a standard design of the respective cartridge magazine. A more recent example of this is US 2017/0321979 A1. Generically, this offers the user the advantage of transforming the cartridge magazine to suit different purposes, because short weapons in particular are often used for different purposes. Thus, a sporting firearm can also serve for self-defense and is also used for hunting in some regions of the world, for example in North America. With regard to the requirement for concealed carry, even temporarily different climatic conditions can have an impact.

However, magazine extensions known to date usually offer little appreciable increase in the capacity of the cartridge magazine.

An exception to this are magazine extensions with a drum-like extension, such as those known from U.S. Pat. No. 4,332,097. However, based on the disadvantages of drum-type magazines already described, such designs are only suitable for very few applications and have therefore never been able to achieve any significant market penetration.

With regard to the aforementioned aspect of adaptation to changing operating conditions, a cartridge magazine has also become known from US 2013/0255 125 A1, the housing of which is designed to be telescopically extendable. Consequently, the operator can choose between a first housing length with a first capacity and a second housing length with a second capacity.

What is needed in the art is at least one alternative to the possibilities known from the current state of the art for adaptation of the capacity of a cartridge magazine for a portable firearm.

In particular, what is needed in the art is a possibility of adaptation of the capacity of a cartridge magazine for a portable weapon that is provided to the user, which is particularly favorable in terms of the ratio of the additional space required and the additional capacity gained, whereby this must be evaluated in particular in relation to a model-specific standard magazine design.

Alternatively or in addition, what is needed in the art is to provide the user with an especially functionally reliable way of adjusting the capacity of a cartridge magazine for a portable firearm.

Alternatively or in addition, what is needed in the art is to provide the user with an especially inexpensive and/or environmentally friendly way of adjusting the capacity of a cartridge magazine for a portable firearm.

SUMMARY OF THE INVENTION

The present invention provides a housing section of the type described at the beginning in that the first region is formed by a first cross-section for accommodating a first number of rows of cartridges arranged next to one another and optionally offset from one another in Z-direction, and that the second region is formed by a second cross-section for accommodating a second number of rows of cartridges arranged side by side and optionally offset from each other in Z-direction, and in that the second number and the first number differ from one another by at least one full numerical value and the first cross section coincides with the first opening cross section.

In this way, at least one alternative is provided to the possibilities known from the current state of the art for adapting the capacity of a cartridge magazine for a handgun.

This provides the user with a way in particular for adapting the capacity of a cartridge magazine for a portable firearm which is particularly favorable in terms of the ratio of the additional space required and the additional capacity gained, whereby this is to be evaluated in particular in relation to a model-specific standard magazine design. In addition, a housing section designed in this way offers basic prerequisites for a particularly functionally reliable possibility of adapting the capacity of a cartridge magazine for a portable firearm and safe operation of a cartridge magazine set up for this purpose or a cartridge magazine supplemented by the housing section or a cartridge magazine including the housing section.

In addition, by providing such a housing section, the user is provided with an especially inexpensive and/or environmentally friendly way of adapting the capacity of a cartridge magazine for a portable firearm, because the user can use, for example, interchangeable magazines that are already available. Optionally, the internal functional elements of the interchangeable magazine are also used. Only, for example, the base cover has to be replaced by another base cover due to the change in the row configuration within the housing section.

The interior space of the housing section may be limited by the interior surfaces of a front wall, a rear wall, a first side wall, and a second side wall, wherein all of the side walls may be collectively formed from a single piece or a single laminate or may be composed of at least two pieces.

It is optional that the first region may be designed to form a first cross-section for accommodating a first number of rows of cartridges arranged immediately adjacent to one another and optionally offset from one another in Z-direction, and that the second region is designed to form a second cross-section for accommodating a second number of rows of cartridges arranged directly adjacent to one another and optionally offset from one another in Z-direction and that the second number and the first number of rows differ from one another by at least one full numerical value and the first cross section is consistent with the first opening cross section.

Due to the fact that the first number of rows of cartridges and the second number of rows of cartridges are each arranged directly adjacent to one another and are optionally offset from one another in Z-direction, an advantage arises in that the cartridge stack sections formed from the first number of rows and from the second number of rows can stabilize each other in a very positive manner and thus form an excellent basis for a safe and reliable function of the cartridge magazine.

It is advantageous if the numerical value of the second number is genuinely larger than the numerical value of the first number. This contributes to a high gain in capacity.

On a case by case basis, it may be optional that the first number has a numerical value of 1 and the second number has a numerical value of 2. In this way, particularly compact, in particular especially slim, cartridge magazines can be achieved by using the housing section.

In other cases it may be optional that the first number has a numerical value of 1 and the second number has a numerical value of 3. This offers an excellent compromise of the previously discussed advantages, even though a combination of two odd numerical values of the configuration within a cartridge magazine applies and therefore seems surprising, even for the arrangement of the proposed housing section.

In yet other cases, it may be optional that the first number has a numerical value of 1 and the second number has a numerical value of 4.

According to the applicant's findings to date, based on a single row configuration this offers the greatest possible gain in capacity, which appears to be feasible in a functionally reliable manner.

In yet other cases, it may be optional that the first number has a numerical value of 2 and the second number has a numerical value of 3.

Such a design may be advantageous depending on the grip design of the portable weapon.

In still other cases, it may be optional that the first number has a numerical value of 2 and the second number has a numerical value of 4.

In other words, the first region is then designed to accommodate two rows of cartridges, optionally arranged directly adjacent to one another, and optionally offset from one another in Z-direction, and the second region is designed to accommodate four rows of cartridges, optionally arranged directly adjacent to one another, and optionally offset from one another in Z-direction.

Such an arrangement may also be advantageous depending on the grip design of the portable firearm. The outer surface of the housing section can then be designed as an extended gripping surface of the handle of the portable firearm and can also be designed, for example, to form an entry stop which prevents the heavy magazine—when fully loaded—from penetrating too deeply into a receiving shaft of a portable firearm which is arranged for this purpose.

If the first number has a numerical value of 2 and the second number has a numerical value of 4, the housing section may be designed for example to provide a total cartridge magazine capacity of, for example, 40, 45, 50, 55, 60, or 65 cartridges. The housing section itself is designed without magazine lips and is therefore not capable of storing cartridges independently. The interior of the housing section, in other words its volume, can however be designed to accommodate a first feeder, a second feeder, a first feeder spring, a second feeder spring, and, for example, 33 cartridges, or 23, 28, 38, 43, or 48 cartridges. For this purpose, the housing section can be at least mostly closed at the bottom of the housing section by a base cover.

One optional embodiment is characterized in that a transitional region is arranged between the first region and the second region, connecting the first region and the second region.

On the one hand, this makes it possible to provide a basis for an especially undisturbed movement pattern of the cartridges and, on the other hand, to provide a way of safely influencing the movement pattern of the first feeder and, in particular, the second feeder.

It is of great advantage if the first region is designed to accommodate the first number of rows of cartridges in such a way that the cartridges of all rows covered by the first number are to be arranged directly adjacent to one another and optionally offset from one another in the Z-direction.

This increases the stability in the cartridge stack. The cartridges or rows of cartridges which are arranged directly adjacent to one another and offset relative to one another in Z-direction, in other words, which touch one another at their shell surfaces, "interlink" in this way, whereby the contact points are actually moved along the shell surfaces of the surfaces of the cartridge (cases).

Accordingly, it is also advantageous if the second region is designed to accommodate the second number of rows of cartridges in such a way that the cartridges of all rows covered by the second number are to be arranged directly next to one another and optionally offset relative to one another in the Z direction.

It is moreover advantageous if the intermediate region is designed to accommodate an intermediate number of rows of cartridges in such a way that the cartridges of all the rows covered by the intermediate number are to be arranged directly next to one another and optionally offset relative to one another in the Z direction.

It is thereby optional for the cartridges to be arranged directly next to one another in all regions covered by the rows and optionally offset relative to one another in the Z-direction, so that support of the cartridge stack, which changes from shot to shot during operation, can be self-adjusting in each loading state.

Consequently this makes a cartridge threading process without outside interference possible, while the number of rows is reduced in the discharge direction.

Provision is made with great advantage, that a first locking section adjoins the first opening cross-section in Z-direction on the upper side of the housing section and/or surrounds the opening cross-section on the outside at least in X-direction and/or Y-direction; wherein the first locking section is designed for releasable locking to a housing of a cartridge magazine for a portable firearm.

This facilitates a secure connection to the housing of a cartridge magazine and trouble-free movement of the cartridges even in and beyond the locking region.

A locking region is advantageously provided on the top side of the housing.

This increases the safety of operational capability.

It is thereby advantageous if the locking region is provided for releasable securement of a locking element.

This increases the manageability and additionally also again the safety of operational capability.

It is herein optional that the locking region has at least one first locking surface and at least one second locking surface.

This makes a locking element virtually captive in operation, yet inexpensive and easy to design and handle.

It is also optional that at least one of the at least one locking surfaces is then arranged at an angle, optionally orthogonally, to at least one insertion surface associated with the locking region and is optionally aligned substantially in Z-direction.

It is generally advantageous if a second locking section adjoins the second opening cross-section in Z-direction on the bottom side of the housing section and/or surrounds the second opening cross-section at least in X-direction and/or Y-direction on the outside, wherein the second locking section is designed for releasable locking to a further housing section for a cartridge magazine for a portable firearm and/or on a base cover.

Thus, the housing section becomes more versatile for the user, who can decide whether to expand a cartridge magazine, for example, by one housing section, two housing sections, three housing sections, or even more housing sections, before closing the resulting cartridge magazine with a base cover.

In a cartridge magazine of the type described above, the present invention provides that the cartridge magazine further includes a housing section, wherein the housing section is defined by a housing section shell extending along an X-axis, a Y-axis, and a Z-axis, wherein the housing section shell has a shell inside surface and a shell outside surface and in its interior includes an interior space that is limited by the shell inside surface, and wherein the interior space forms at least a first region and a second region, wherein the housing section includes a housing section top side and a housing section top side, wherein the housing section top side has a first opening cross section and the housing section bottom side has a second opening cross section, wherein the first region is designed to form a first cross-section for accommodating a first number of rows of cartridges arranged adjacent to one another and optionally offset from one another in Z-direction, and that the second region is designed to form a second cross-section for accommodating a second number of rows of cartridges arranged adjacent to one another and optionally offset from one another in Z-direction and that the second number and the first number of rows differ from one another by at least one full numerical value and the first cross section is consistent with the first opening cross section, and wherein the housing section is arranged between the housing and the base cover.

The resulting advantages are apparent to an expert, analogous from the overall disclosure content of the present application and have already been described for the most part in connection with the description of the advantages of the housing section, so that unnecessary repetition will be dispensed with here.

In the previously described context it is optional that the cartridge magazine includes a housing.

The advantages resulting therefrom are also to be taken analogously from the disclosure made in connection with the description of the housing section and can be transferred accordingly by the expert.

Further, it is of considerable advantage if the at least one feeder is formed by a first feeder, wherein the cartridge magazine further has a second feeder, and the first feeder and the second feeder are designed such that the first feeder is at least partially movable into the space of the second feeder, and optionally moreover the at least one feeder spring is represented by a first feeder spring arranged between the second feeder and the bottom cover, wherein the cartridge magazine moreover has a second feeder spring which is arranged between the second feeder and the first feeder.

Such an arrangement allows the first feeder to disengage from the space of the second feeder without jerking, especially in the intermediate region. Thus, a destabilization of the cartridge (row) stack can be reliably avoided.

In some cases, it may be optional that the first feeder is arranged to be movable through a first degree of freedom and a second degree of freedom within the housing and/or the housing section and, in particular, within the second feeder.

For example, this makes pivoting about a Y-axis possible, in other words, provides a different tiltability of the first feeder relative to the X-axis.

It is therein optional that the first feeder is arranged to be pivotable, from a first position in which it is at least partially arranged within the second feeder into a second position in which it is arranged at least partially within the second feeder, relative to the X-axis, wherein the pivot angle is optionally between at least 4°, in particular at least 8°, especially between 12° and 21° to a maximum of 33°.

In contrast, it may be optional in other cases that the first feeder is arranged to pivot relative to the X-axis from a first position in which it is arranged at least partially inside the second feeder to a second position in which it is arranged outside the second feeder, wherein the pivot angle optionally being between at least 4°, in particular at least 8°, especially between 12° and 21° to a maximum of 33°.

It may herein even be optional that the feeder (already) in an intermediate position, in which it is (also) arranged outside the second feeder, achieves an orientation with respect to the swivel angle that deviates from the orientation of the feeder in the first position by a maximum of 1.5°, optionally less than 1°, especially less than 0.5°.

Both arrangements are suitable for maintaining the contact of the feeder with the (lowest) cartridges in the cartridge stack or respectively the cartridge row stack, over the entire range of possible loading states.

In order to achieve an unstacking sequence that is as uniform as possible during operation of a portable firearm equipped with a cartridge magazine having a housing section according to the present invention, it would in fact be obvious to support a pivot angle progression of the first feeder by way of a second pivot angle progression of the second feeder, which optionally precedes said first pivot angle progression. It has however been found that, surprisingly, it appears to be advantageous if the second feeder—as the base of the first feeder —does not tilt or at most only tilts minimally along a second pivot angle progression. This means that its pivoting angle (progression) is clearly limited to, or optionally remains at below 5°, optionally below 2°, especially below 1° angle of inclination during the entire unstacking process.

It can herein be advantageously provided that the second feeder in its upper position —in other words, in the position from which the first feeder moves out of the interior and subsequently also out of the region of the second feeder during the further process of unstacking that occurs during operation of the portable firearm by respective removal of the uppermost cartridge—is fixed in position on the housing side so that its possible angle of inclination is clearly limited optionally to below 5°, optionally to below 2°, optionally to below 1°. For this purpose, the second feeder may have upwardly open grooves which may have corresponding webs, directed downward, formed inside the housing when the second feeder is moved to its upper final position. Such a design has the advantage that, on the one hand, it provides a very good stabilizing effect and, in particular, can prevent technically relevant pivoting and, on the other hand, it does not increase the risk of malfunctions because it is consistent with the loading and unloading sequence (stacking and unstacking sequence) of the cartridge magazine. Moreover, such a measure to be provided on the housing and feeder side can be implemented without having to expect that significant increases in the cost of the mold construction would occur.

In order to support this effect, but also to increase the stability of the cartridge stack as a whole and to promote proper "linking" of the cartridges (rows) with each other, it is also especially advantageous if the first feeder and the second feeder are coordinated with each other so that a row of cartridges which is positioned vertically below the magazine lips represents the lowest cartridge. In other words, depending on the design adaptability of the cartridge magazine (and the housing section), it may be optional that the first feeder and the second feeder are coordinated with each other such that a cartridge support surface formed by the first feeder is separated by the center plane.

In addition or alternatively, reliable, repeatable linking of the adjacent rows of cartridges during the unstacking process, which is timed in discrete steps at high frequency during the operation of a portable firearm, can be promoted in a surprising manner by the fact that the inside shell surface of the housing section is rougher than the inside shell surface of the cartridge magazine.

It is in fact still assumed that the lowest possible friction of the inside walls of a cartridge magazine is particularly advantageous, especially if the cartridge magazine is designed as a multi-row magazine. Accordingly, it would stand to reason that a housing section expanding a cartridge magazine downward should have an inside housing shell surface that has less, or at least the same, roughness as the inside surface of the housing shell of the cartridge magazine. According to this assumption, this should apply all the more if the housing section is designed in such a way that the second number of rows of cartridges which can be arranged adjacent to one another is designed to be larger than the first number of rows of cartridges which may be arranged adjacent to one another.

Since however, tests have surprisingly shown the opposite, it is assumed that the susceptibility to malfunction of a cartridge magazine supplemented in this manner by a housing section is reduced overall because the outer cartridges, which otherwise tend to "overtake" the cartridges adjacent to them in an inner cartridge row when they are inserted, are slightly slowed down.

Ideally, it is moreover suggested that the roughness of the inside shell surface in such cases increases steadily or discretely from the upper region to the lower region of the shell section.

Overall, however, the roughness values should not exceed Rz=50 and should be at a ratio of 1:1.1 to 1:2.75.

It is very advantageous if the cartridge magazine moreover includes a locking element.

Then, it is advantageous if the locking element has a first leg having a first latch surface and a second leg having a second latch surface, wherein between the first leg and the second leg a connecting region is provided which is connected to a blocking region or forms a blocking region, wherein the blocking region has at least one contact surface which is designed to accommodate a functional contact with the housing.

The advantages which can be claimed in this connection have also already been described.

The locking element is designed particularly optionally to be C-shaped.

It is also particularly advantageous if at least the first latch surface and/or at least the second latch surface is designed to accommodate a functional contact with the housing section, and in particular with at least one locking surface thereof.

In addition, it can be advantageous if a distance is provided between the first leg and the second leg, in particular between the first latch surface and the second latch surface, and if the locking element is designed in such a way that the distance can be varied, in particular increased, due to the effect of an expanding force upon the connecting region.

These design features contribute to improved safety, low-cost designability and manageability.

In a conversion kit of the aforementioned type, the present invention provides that the conversion kit includes at least the following:

- a housing section according to what is described herein (the housing section is also claimed in claims 1-9);
- optionally a second, feeder;
- at least one feeder spring;
- a bottom cover which is suitable to close—at least extensively—the second opening cross section of the housing section.

The advantages resulting therefrom are to be taken analogously from the disclosure made in connection with the description of the housing section and can be transferred accordingly by the expert.

The conversion kit optionally includes a first feeder spring and a second feeder spring.

By this way, the conversion kit can be particularly well adapted to occurring demands.

Alternatively, or in addition, the conversion kit advantageously includes a locking element.

The advantages resulting therefrom are to be taken analogously from the disclosure made in connection with the description of the cartridge magazine and can be transferred accordingly by the expert.

In a method to convert a cartridge magazine for a portable firearm, the present invention provides that the method is characterized by the following steps:

a) provision of a housing section;
b) removal of the bottom cover of the cartridge magazine;
c) removal of the at least one feeder and the at least one feeder spring;
d) locking the housing section to a housing of a cartridge magazine;
e) insertion of a first feeder, a second feeder spring, a second feeder and a first feeder spring;
f) attachment of the bottom plate, wherein the provision of the housing section in step a) is accomplished by provision of a housing section according to what is described herein and/or of a conversion kit according to what is described herein.

The advantages resulting therefrom are to be taken analogously from the disclosure made in connection with the description of the housing section and/or the cartridge magazine and can be transferred accordingly by the expert.

In a method of operating a portable firearm with a cartridge magazine, the present invention provides that, when operating the portable firearm, a cartridge magazine according to what is described herein (the cartridge magazine is also claimed in claims 11-15) and/or a cartridge magazine which is connected with a housing section according to what is described herein (the housing section is also claimed in claims 1-9) is used.

Optionally, a cartridge magazine produced by use of a (manufacturing) process according to what is described herein is used for implementation of the method (of operating a portable firearm with a cartridge magazine) according to what is described herein.

Also, the advantages resulting therefrom are to be taken analogously from the disclosure made in connection with the description of the housing section and/or the cartridge magazine and can be transferred accordingly by the expert.

With regard to the design of the housing of the cartridge magazine and/or the housing section, the following arrangements may also be optional, wherein, respectively a particular advantage results if the design features outlined below are applied to the housing as well as to the housing section of the cartridge magazine that is to be assembled or of the assembled cartridge magazine, thus representing a unit.

Thus, it may first of all be optional occasionally for the housing and/or housing section that the inside surface of the respective front wall has a first protrusion which protrudes into the interior of the housing/housing section in the direction of the X-axis and extends along the Z-axis, originating from the respective intermediate region at least also partially into the first region and at least also partially into the second region, and the inside surface of the respective rear wall has a second protrusion, which protrudes into the interior of the housing/housing section in the direction of the X-axis and along the Z-axis starts in the first region and ends in the intermediate region.

In this way, the order between the individual cartridges to be accommodated in the housing/housing section of the cartridge magazine can be improved. The second protrusion allows the cartridges to be slightly spread apart in their position in the rear region, allowing them to be easily aligned with each other in their front region. This improves the integration behavior of the individual cartridges among each other when reducing the rows of cartridges formed by them in the magazine. The effect is particularly strong if the cartridges have a bottle-shaped case/bottle-shaped shell. Both, the first protrusion and the second protrusion are suitable for guiding the feeder(s) of a cartridge magazine and, not least, contribute significantly to the stability of the housing/housing section.

It may also be optional for the housing and/or housing section that the inside surfaces of the first side wall and the second side wall are arranged substantially parallel to each other in the first region and the second region, and that a virtual center plane in the X- and Z-directions is formed between them in the Y-direction.

In this way, a repeatable process of cartridge movement within the housing/housing section of the cartridge magazine is additionally supported during operation.

Moreover, it may be advantageous for the design of the housing and/or housing section if the cross-section of the respective first (housing) region extending along the X-axis and the Y-axis is divided into a rectangular zone and into a trapezoidal zone adjacent to the rectangular zone, and the cross-section of the respective second (housing) region extending along the X-axis and the Y-axis is divided into a rectangular zone and a trapezoidal zone adjacent to the rectangular zone.

In this way, the stability of the housing and/or the housing section is strengthened.

In addition, previously mentioned effects can thereby be supported, for example forcing the cartridges located in the cartridge magazine to tilt slightly towards each other by way of the housing and/or the housing section.

Further, such a cross-section is also particularly suitable for cartridges with bottle-shaped silhouettes.

Handling of the cartridge magazine can also be improved, if the outside shape of the housing/housing section is based on this cross section.

It is then very advantageous to ensure that the first projection is arranged at least in sections inside the center plane and/or the second projection is arranged at least in sections inside the center plane.

This increases the stability of the housing and/or the housing section in a particularly simple manner. In addition, such a design promotes a trouble-free process when rearranging the cartridges from a four-row arrangement into a two-row arrangement within the housing and/or housing section.

It is then also optional that the extension of the first protrusion in the X-direction is between 5% of A and 30% of A, in particular between 5% of A and 18% of A and especially between 8% of A and 13% of A, and/or that the extension of the second protrusion in the X-direction is between 5% of A and 30% of A, in particular between 5% of A and 18% of A and especially between 8% of A and 13% of A.

The projections thus point towards each other in the interior of the housing and/or the housing section.

Surprisingly, these values achieved especially good results in regard to the operational safety of the cartridge magazine and of a portable firearm equipped with such a cartridge magazine, and in regard to the stability of the housing/housing section of the cartridge magazine.

Moreover, cartridge magazine designed in this manner showed themselves to be especially resistant against contamination and were able to maintain their full functional reliability even under extreme contamination.

Nevertheless, in other cases, it may be optional that the extension of the first protrusion in the X-direction is less than 4.5% of A, in particular less than 2.5% of A, and especially less than 1.5° % of A, and/or that the extension of the second protrusion in the X-direction is less than 4.5% of A, in particular less than 2.5% of A, and especially less than 1.5° % of A.

It may therein even be particularly optional that the respective inside surface of the respective front and/or rear wall of the housing section and/or of the housing are arranged in at least one region, optionally in all regions, without a protrusion extending into the interior space in X-direction.

Surprisingly, tests have shown that short cartridges in particular, with a ratio of cartridge length to projectile caliber of less than 3.05, optionally less than 2.65, especially less than 2.42, can then move particularly smoothly within the housing and/or the housing section and support each other in a particularly stable manner. With ratios above 4.0 to above 4.5, on the other hand, exactly the opposite occurs. No clear findings could be obtained for ratios between 3.05 and approximately 4.0 or 4.5. Therefore, it is optional in this context that the latter feature is coordinated, respectively linked, with the design of the interior of the housing section and/or the housing of the cartridge magazine with such a ratio and to the at least two different row configurations in the respective associated regions.

For this purpose, in particular, the first cross section and the second cross section of the housing section must be adapted, in other words specified to this ratio.

The inner surface of the rear wall has optionally two grooves in at least one region, which—if a protrusion is provided—respectively progress laterally, optionally directly, adjacent to the second protrusion.

In this way, particularly stable guidance of a feeder can be made possible if the feeder is shaped accordingly. In addition, such a design enhances dirt resistance of the housing/housing section.

To this end, the extension of the two grooves in X-direction can be, for example, between 2% of A and 9% of A, in particular between 3% of A and 8% of A, and especially between 4% of A and 6% of A. Surprisingly, material recesses in this area even increase the rigidity of the housing/housing section and thus of the cartridge magazine.

It can also be advantageous, if the inside surface of the first side wall has an additional protrusion which extends in the direction of the Y-axis into the interior of the housing section and/or the housing and along the Z-axis has a beginning in the (respective) first region and an end in the (respective) intermediate region or in the (respective) second region; and/or if the inside surface of the (respective) second side wall has an additional protrusion, which protrudes in the direction of the Y-axis into the interior of the housing section and/or the housing and along the Z-axis has a beginning in the (respective) first region and an end in the (respective) intermediate region or in the (respective) second region.

In this way, the cartridge feeder or feeders and/or the cartridges can also be guided laterally, further reducing the risk of cartridge and/or cartridge feeder misalignment and a possible malfunction of the cartridge magazine resulting therefrom. In addition, such protrusions enhance the rigidity and stability of the housing.

Another important advantage is that the cartridges are then guided with very little friction at the relatively narrow front areas of the protrusions. Moreover, the frictional resistance encountered by the cartridges and/or the cartridge feeders on their path in the main direction along the Z-axis and toward the magazine lips always remains approximately identical, whether the cartridge magazine is virtually clean or very dirty, so that the desired repeatability in the operation of the portable firearm can be maintained regardless of the degree of contamination.

It may herein be of additional advantage if the protrusion or the additional protrusions is/are located in a boundary region between the rectangular zone and the trapezoidal zone of the cross-section of the respective region adjacent to the rectangular zone.

Surprisingly, it has been found that it is advantageous to support the cartridge feeder(s) and or the cartridges laterally, optionally by way of only a single protrusion, wherein it is advantageous if the protrusion is located from the inside surface of the rear wall at a distance of approximately 0.65 times distance A to 0.85 times distance A.

An advantageous embodiment results when the inside surface of the first side wall is formed in the intermediate region along a first curved path and the inside surface of the second side wall is formed in the intermediate region along a second curved path, wherein the curved paths respectively include a turning point and extend from the bottom side of the housing to the top side of the housing prior to the respective turning point in the direction of the center plane, and behind the respective turning point adjoin a first and a second parallel to the center plane.

In this manner, an especially gentle guidance of cartridges and/or cartridge feeders is achieved. This contributes considerably to a stable, defined, and repeatable operation.

It can thereby be especially advantageous if the curved paths are of a mirror-symmetrical design.

This is particularly well suited to a cartridge having a symmetrical design.

Additionally, it may also be advantageous if the first and the second curved path are offset relative to one another in Z-direction by an offset V.

This facilitates trouble-free rearranging of the cartridges among each other.

The housing section and/or the housing itself are advantageously designed as a single component.

In this way, the stability of the housing section and/or the housing and of a cartridge magazine including the two components is considerably strengthened. In addition, inner and outer surfaces can be designed particularly freely, and disruptive material overlaps resulting from joining work can be easily avoided. Brittleness, for example due to welding, can also be avoided.

The housing consists optionally of a homogeneous material, wherein in particular the texture of the material is uniform over the entire housing section and/or the entire housing.

For the purposes of the current document, the material structure is also homogeneous if the material is a reinforced material.

It is especially advantageous if the housing consists of plastic.

This allows the provision of especially lightweight and resistant housings. A polyamide (PA), in particular a reinforced polyamide or a polyether-ether-ketone (PEEK), is optionally used.

In order to be able to achieve particularly inexpensive production, for example for so-called "disposable cartridge magazines", a polyethylene (PE) can also be used.

An injected, stabilizing metal structure and/or metal component can also be used, for example to provide a particular required locking area on the housing section and/or the housing.

It can moreover be advantageous if the housing section and/or the housing has a window which is appropriately formed or covered by a, more or less, transparent, in other words clear or opaque plastic. If the window is formed by an area made of clear or opaque plastic, it is optional that the area is manufactured in a two-component injection molding process together with the remaining area of the housing section or respectively the housing. It is thereby important, that both areas are produced in the same injection mold and that the respective plastic materials, in other words the transparent plastic for the window region, and in a practical sense, the opaque plastic for the remaining housing section shell or the remaining housing shell, are injected into the mold consecutively, so that the plastic injected first is at least not yet completely solidified by cooling.

An optional embodiment of the present invention is explained below in more detail with reference to the figures of a single drawing. The description of the optional embodiment is by no way to be regarded as conclusive.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate at least one embodiment of the invention, and such exemplifications are not to be construed as limiting the scope of the invention in any manner.

DETAILED DESCRIPTION OF THE INVENTION

FIGS. 1*a* to 6*b* show a single optional design example of an inventive housing section, cartridge magazine and conversion kit. Identical components are identified in the same manner in all figures and do not have to be shown or be visible in all figures or be described again in all figures.

Figures 1A, 1B:
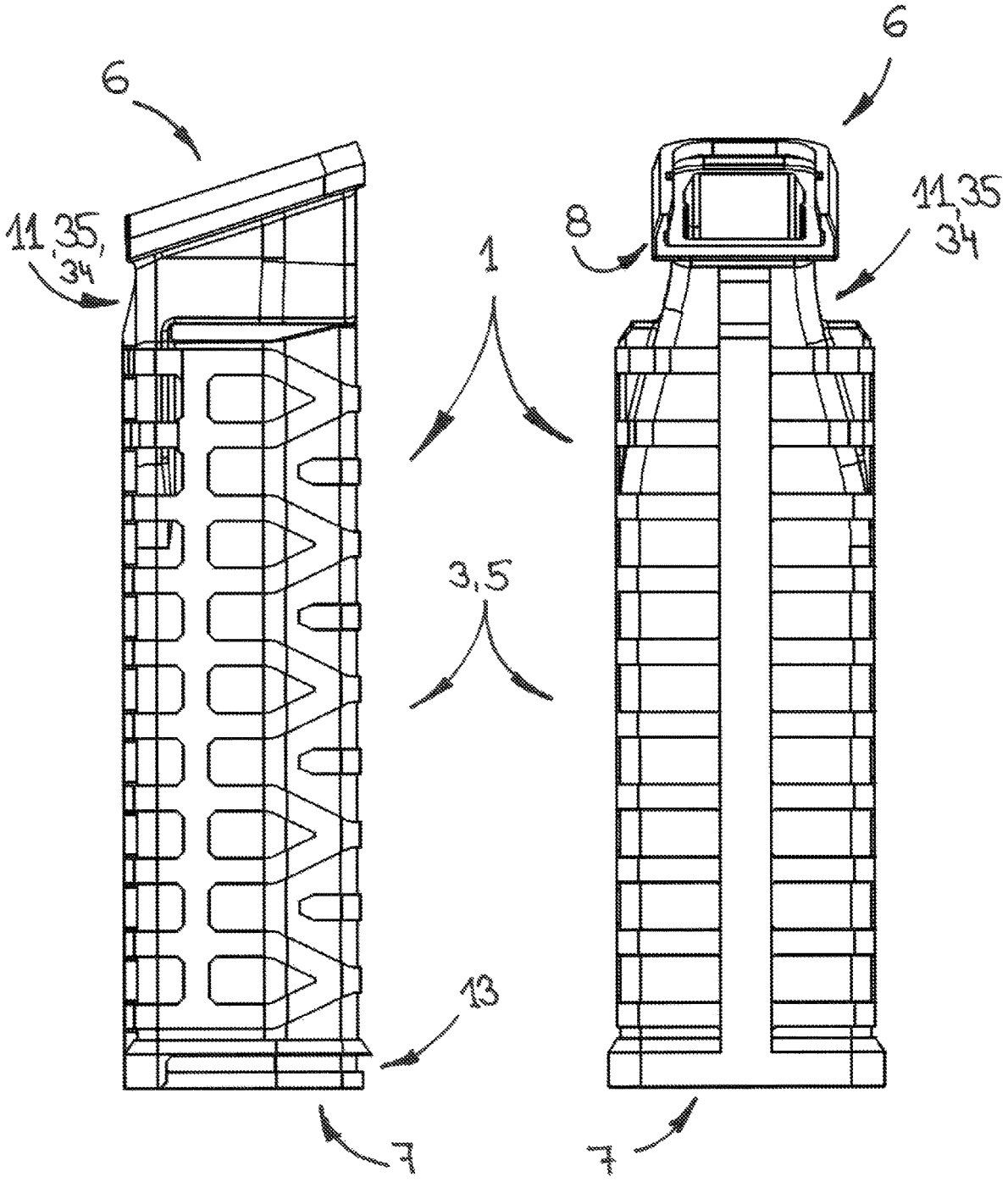
FIG. 1*a* is a right side view of the housing section.
FIG. 1*b* is a rear view of the housing section.
Figure 1C:
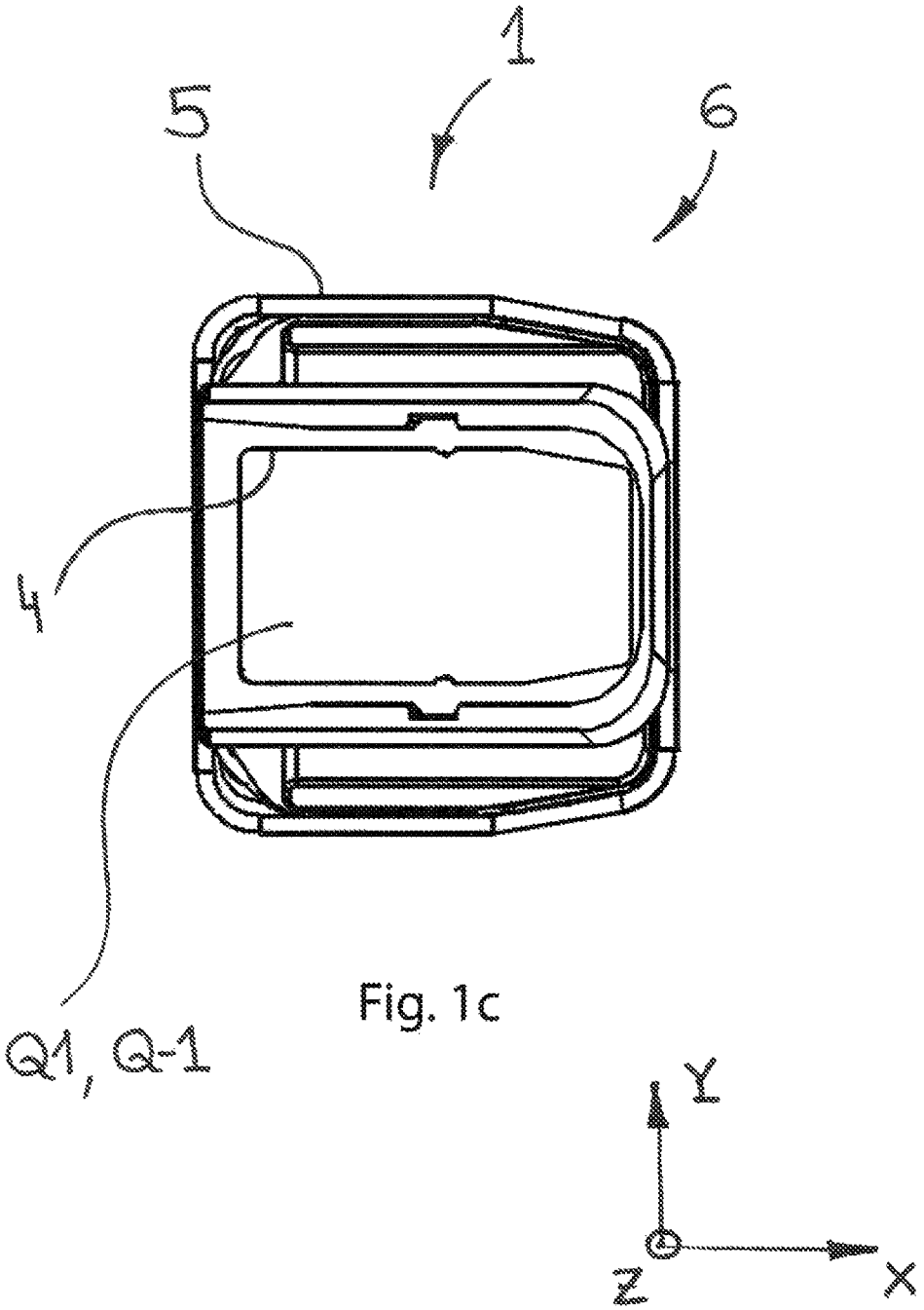
FIG. 1*c* is a top view of the housing section.

FIG. 1*a* shows a right side view of housing section 1 for a cartridge magazine 2 and/or a cartridge magazine 10. FIG. 1*b* shows a rear view of housing section 1, and FIG. 1*c* is a top view of housing section 1.

Figure 2A:
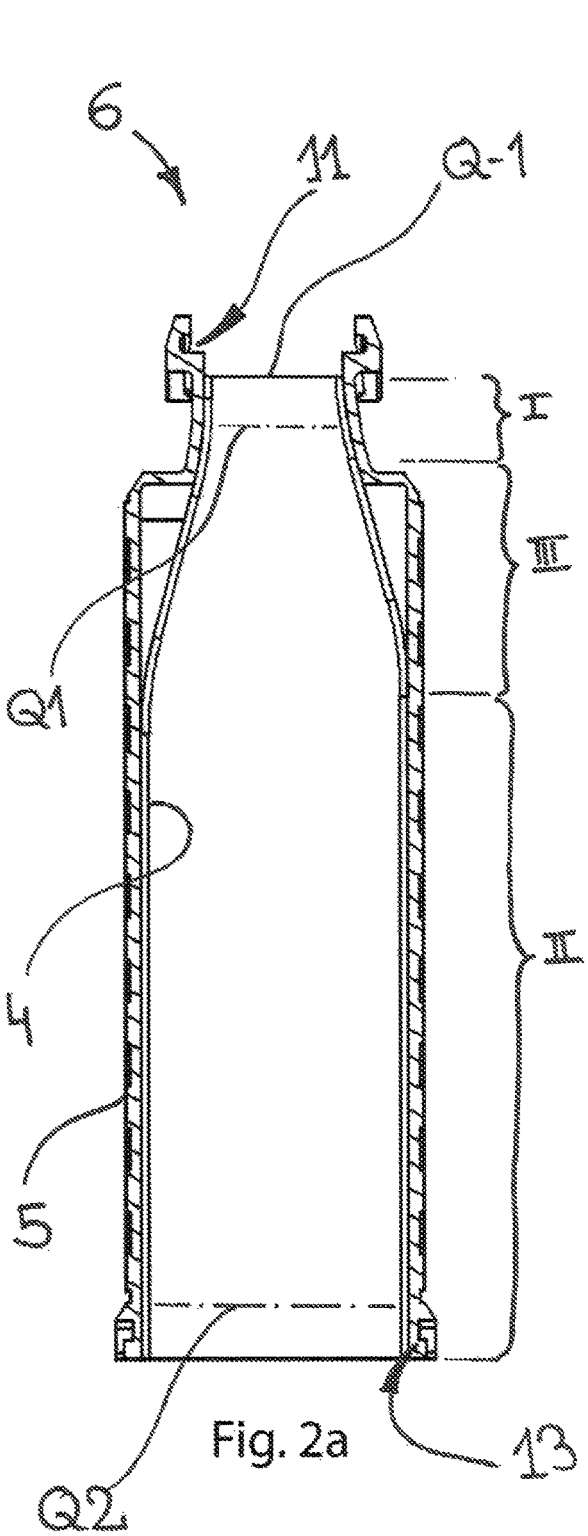
FIG. 2*a* is a longitudinal section through the housing section.
Figure 2B:
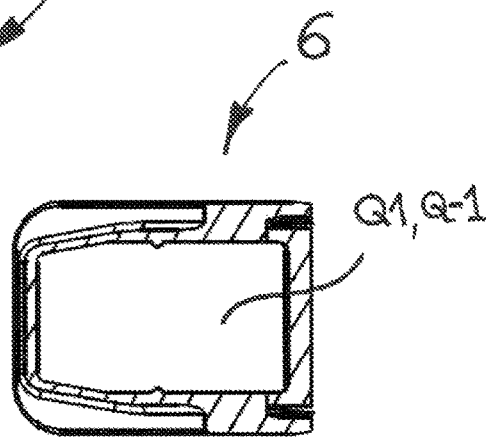
FIG. 2*b* is a first cross section.
Figure 2C:
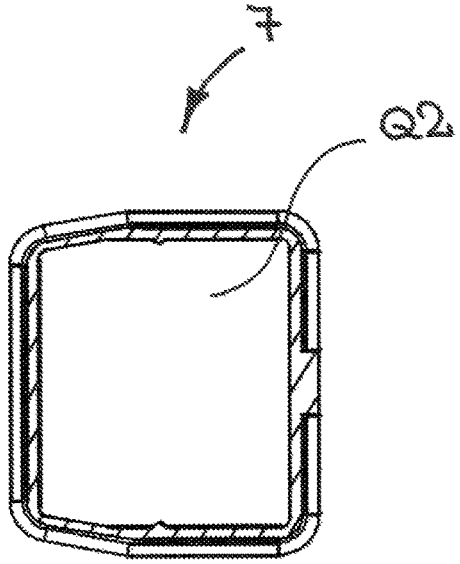
FIG. 2*c* is a second cross section.

FIG. 2*a* shows a longitudinal section through housing section 1, FIG. 2*b* shows a first cross section Q1 of housing section 1, and FIG. 2*c* shows a second cross section Q2 of housing section 1.

Figures 3A, 3B, 3C:
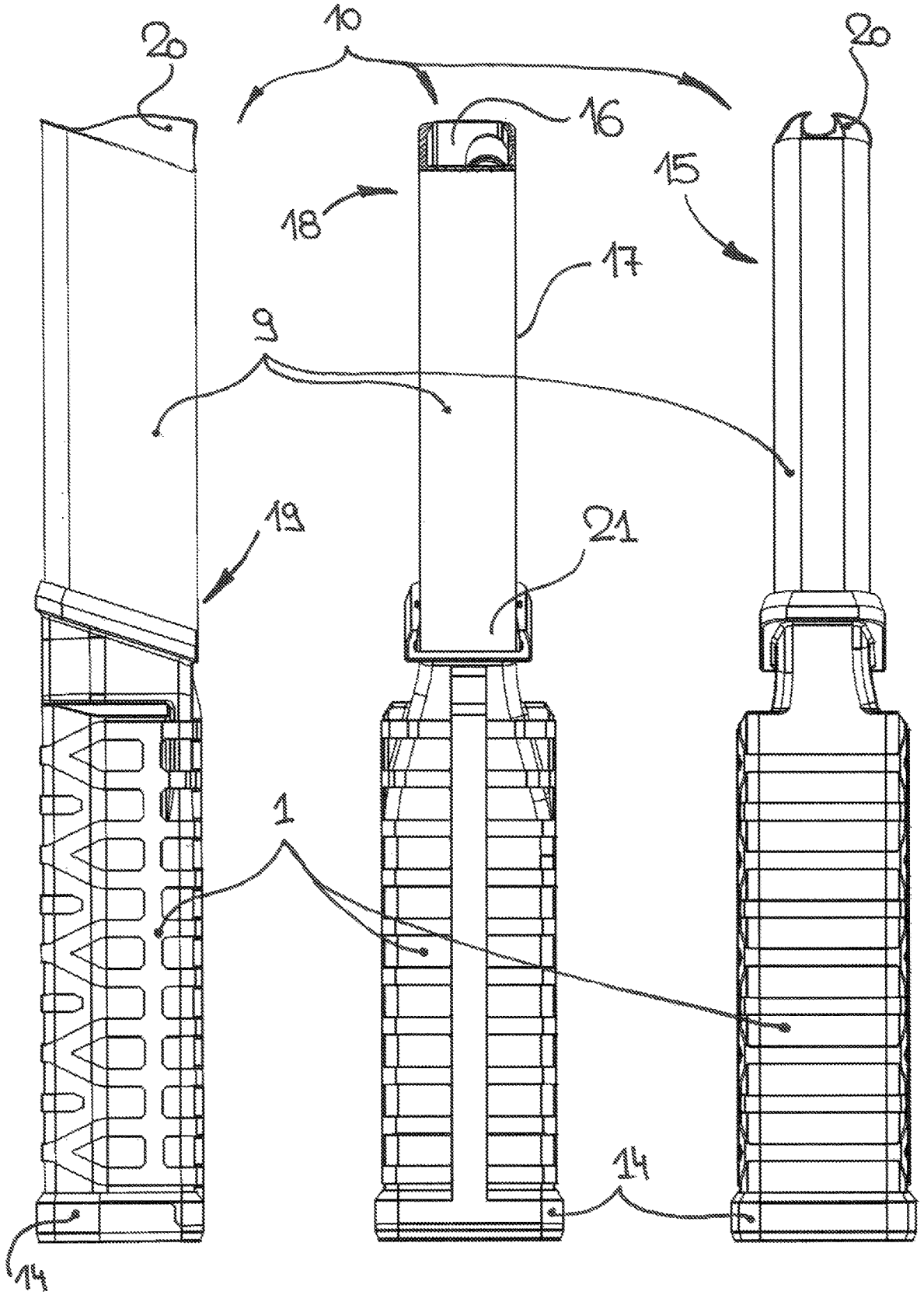
FIG. 3*a* is a left side view of cartridge magazine with housing section.
FIG. 3*b* is a rear view of cartridge magazine with housing section.
FIG. 3*c* is a front view of cartridge magazine with housing section.

FIG. 3*a* shows a sectional left side view of cartridge magazine 10 with housing section 1, FIG. 3*b* shows a rear view of cartridge magazine 10 with housing section 1, and FIG. 3*c* shows a front view of cartridge magazine 10 with housing section 1.

Figure 4A:
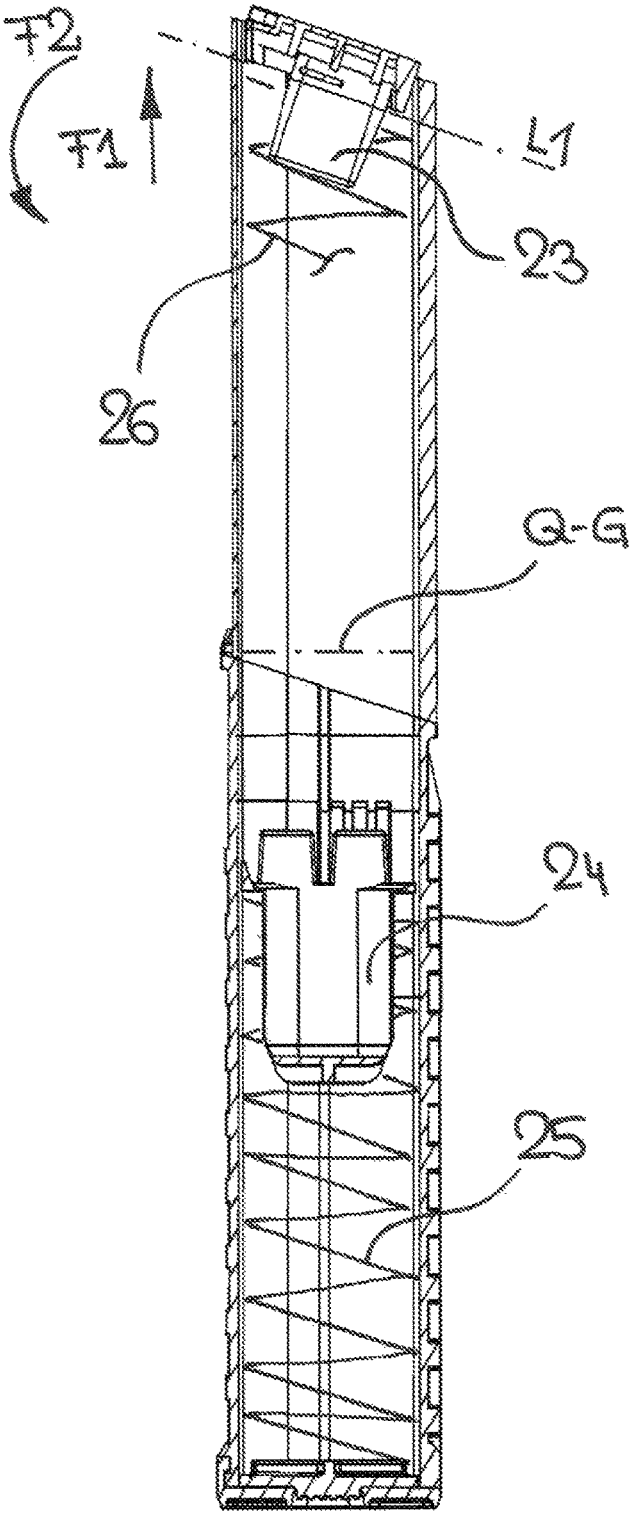
FIG. 4*a* is a section of left side view of cartridge magazine with housing section, first feeder, first feeder spring, second feeder, second feeder spring and base cover.
Figure 5:
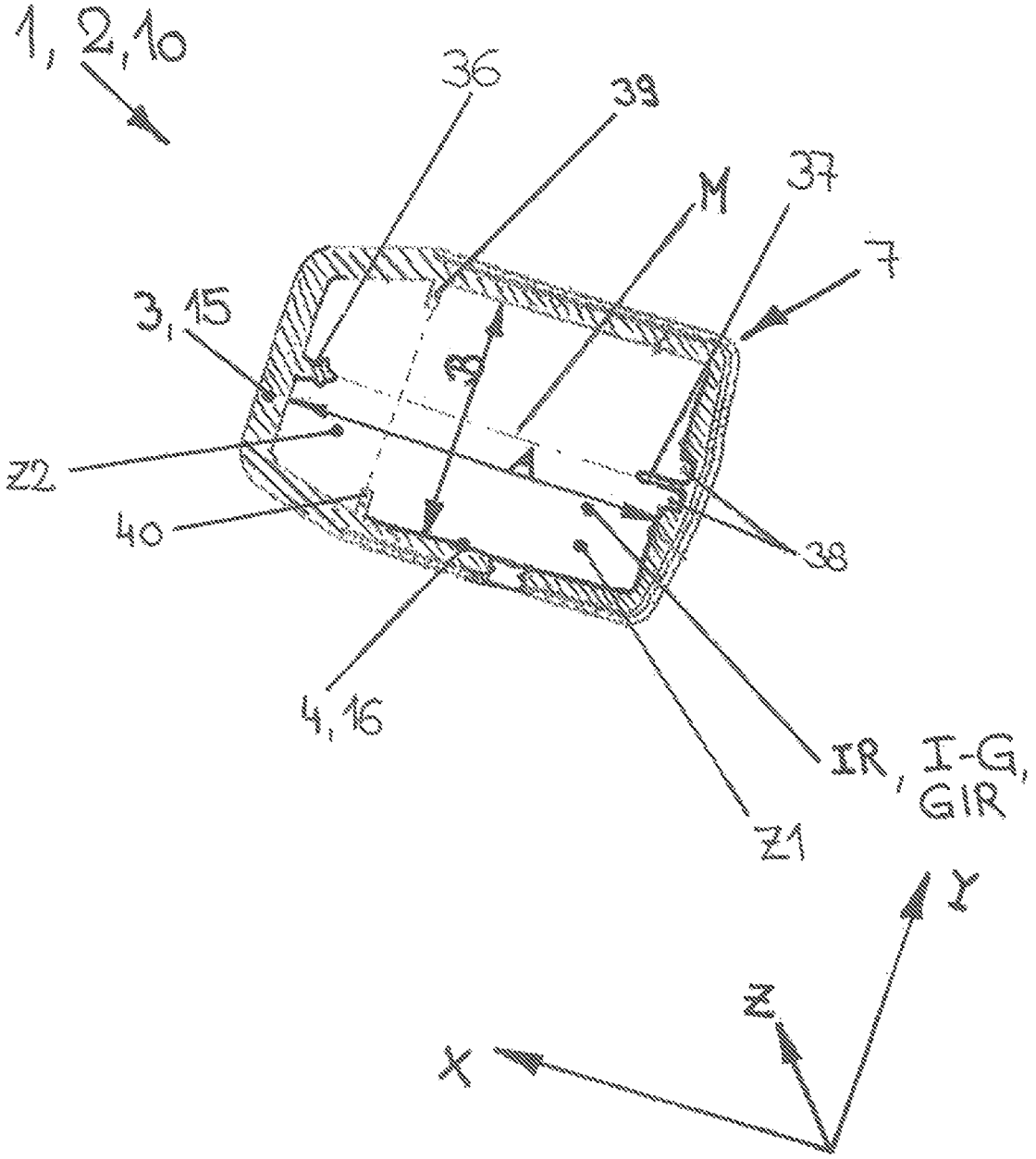
FIG. 5 is a optional profile design of housing section shell and/or housing shell.
Figure 6A:
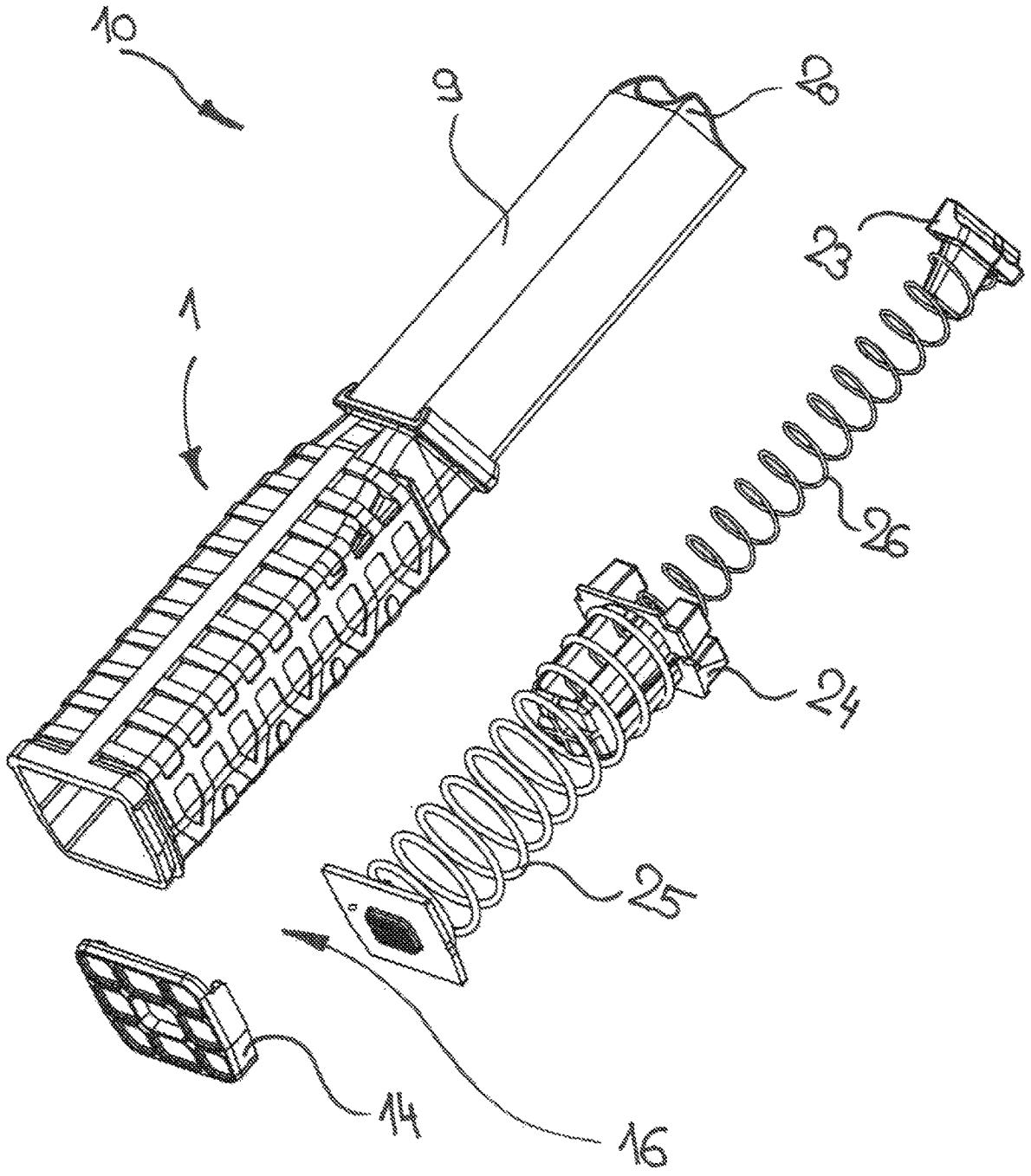
FIG. 6*a* is an cartridge magazine and conversion kit with housing section in partially detached state.

FIG. 4*a* shows a sectional left side view of cartridge magazine 10 with housing section 1, a first feeder 23, a first feeder spring 25, a second feeder 24, a second feeder spring 26 and a floor cover 14, which includes a base cover 22, not shown, of an original cartridge magazine 2 also shown only in FIG. 6*a*, which, except for the original base cover 22, becomes part of cartridge magazine 10 by using the conversion kit shown in FIGS. 5*a* and 5*b*.

Figure 4B:
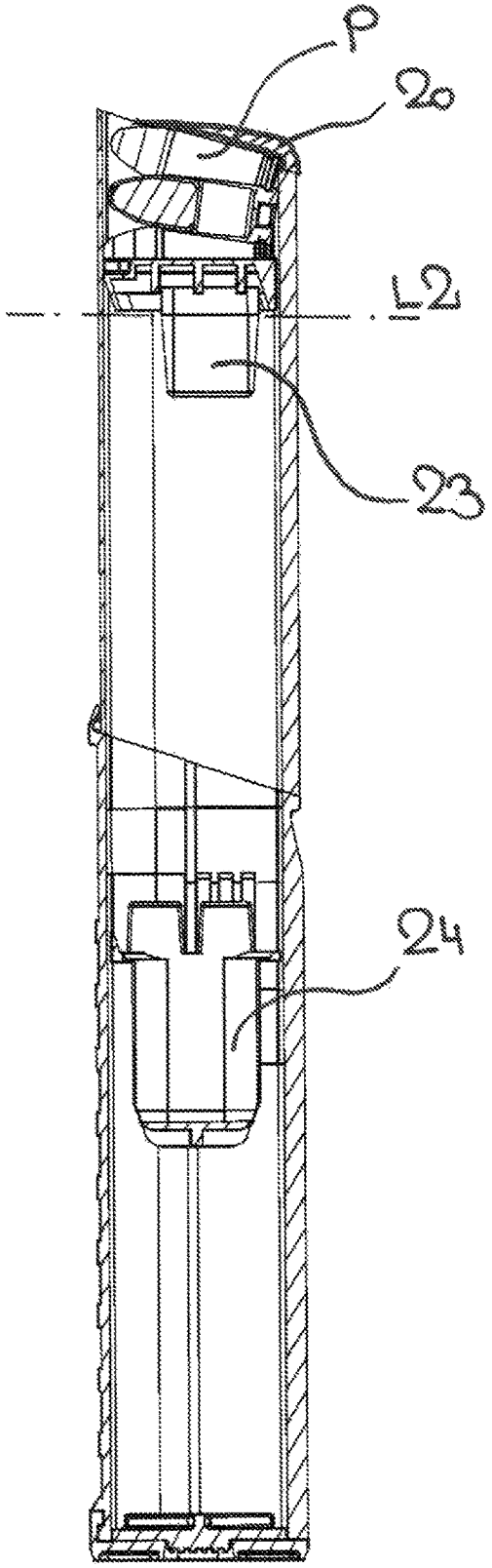
FIG. 4*b* is a section of left side view of cartridge magazine with housing section, first feeder, first feeder spring, second feeder, second feeder spring and base cover, partially loaded with cartridges.

FIG. 4*b* shows a sectional left side view of cartridge magazine 10 with housing section 1, feeder 23, first feeder spring 25, second feeder spring 24, second feeder spring 26 and base cover 14 in a state, partially loaded with cartridges P.

Figures 4C, 4D:
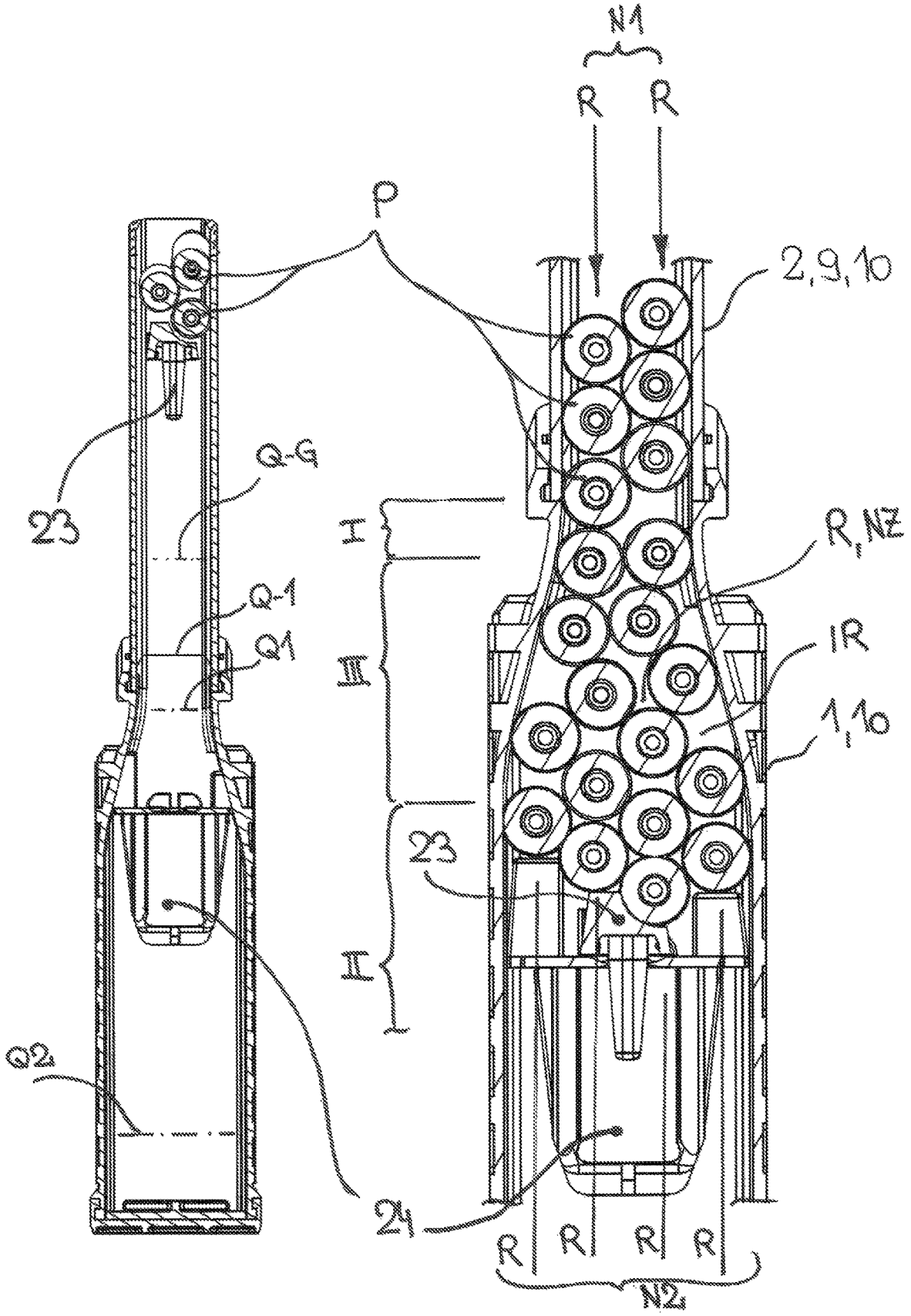
FIG. 4*c* is a section of rearview of cartridge magazine with housing section, first feeder, first feeder spring, second feeder, second feeder spring and base cover, partially loaded with cartridges.
FIG. 4*d* is a section of rear detailed view of cartridge magazine with housing section, first feeder, first feeder spring, second feeder, second feeder spring and base cover, in an advanced partially loaded state.

FIG. 4*c* shows a sectional rear view of cartridge magazine 10 with housing section 1, feeder 23, first feeder spring 25, second feeder spring 24, second feeder spring 26 and base cover 14 in a state, partially loaded with cartridges P.

FIG. 4*d* shows a sectional rear detailed view of cartridge magazine 10 with housing section 1, feeder 23, first feeder spring 25, second feeder 24, second feeder spring 26 and base cover 14 in an advanced state, partially loaded with cartridges P. First feeder 23 is herein pivoted from a first position L1 to a second position L2 around a pivot angle, wherein first feeder 23 is located outside a space of the second feeder.

FIG. 5 shows a possible profile design of housing section shell 3 and/or of housing shell 15.

Figure 6B:
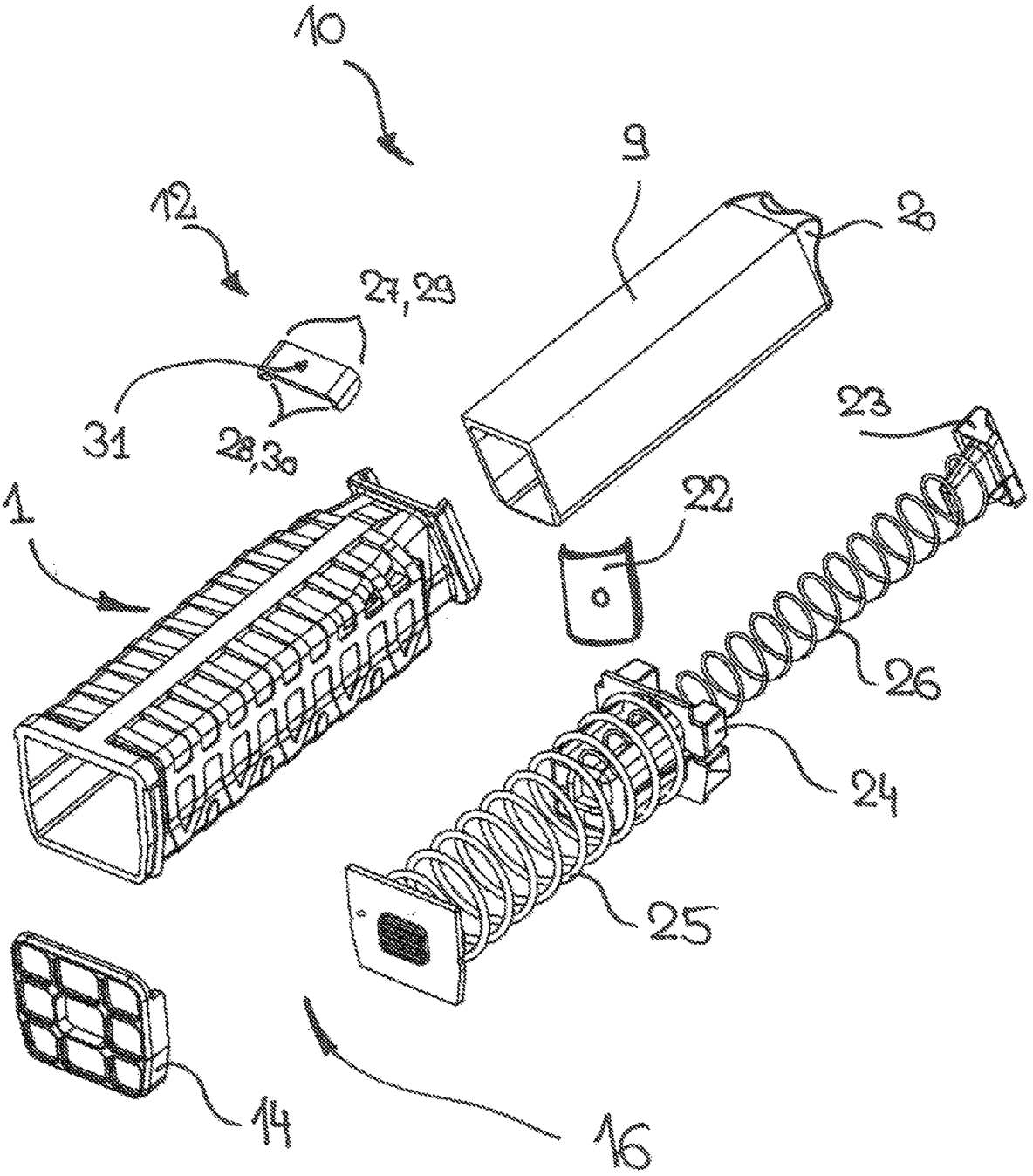
FIG. 6*b* is a cartridge magazine and conversion kit with housing section in partially detached state.

FIG. 6*a* shows a cartridge magazine 2, 10 and a conversion kit with housing section 1 in a partially detached state, wherein FIG. 6*b* shows cartridge magazine 10 and the conversion kit with housing section 1 in a further assembled, however still partially detached, state.

Disclosed in the drawings and shown at least in respective individual figures is a housing section 1 for a cartridge magazine 2, and/or 10 for a portable firearm which is not shown here and which may be designed as a long weapon or as a short weapon, wherein housing section 1 is defined by a housing section shell 3, extending along an X-axis, a Y-axis and a Z-axis, wherein housing section shell 3 forms an inside shell surface 4 and an outside shell surface 5 and in its interior includes an interior space IR, limited by inside shell surface 4, and interior space IR forms at least a first region I and a second region II, wherein housing section 1 includes a housing section top side 6 and a housing section bottom side 7, wherein housing section top side 6 has a first opening cross section Q-1, and housing section bottom side 7 has a second opening cross section Q-2, wherein first region I is formed by a first cross-section Q1 for accommodating a first number N1 of rows R of cartridges P arranged next to one another and optionally offset from one another in the Z-direction, and that second region II is formed by a second cross-section Q2 for accommodating a second number N2 of rows R of cartridges P arranged side by side and optionally offset from each other in the Z-direction, and wherein second number N2 and first number N1 differ from one another by at least one full numerical value, and first cross section Q1 is consistent with first opening cross section Q-1.

In the illustrated example, housing section 1 is designed such that its first locking section is configured for a cartridge magazine 2 of a self-loading pistol, in particular for a model from the Glock pistol series, for example Model 17, Model 19 or another model. This series of pistols or family of models has a very wide distribution in the police market today. In the USA, about 40% of all police officers are equipped with a model from this model family. Cartridge magazines 2 of this family of models are designed in two rows, so that in this case the following applies for the housing section 1: first number N1 assumes a numerical value of 2. To achieve the highest possible magazine capacity gains and also to make the grip design as ergonomic as possible for the operator, for example a police officer, second number N2 has herein a numerical value of 4. In other words, the first region is then designed to accommodate two rows of cartridges, optionally arranged directly next to one another and optionally offset from one another in Z-direction, and the second region is designed to accommodate four rows of cartridges, optionally arranged directly next to one another and optionally offset from one another in Z-direction.

Another self-loading pistol model that is also very popular around the world is the Model 1911, which was originally introduced to the market by Colt and since then has been, and still is, produced in almost countless variations by a variety of different manufacturers. Model 1911 was originally designed for a single-row cartridge magazine, so that a housing section 1 aligned therewith is then designed in such a way that the first number assumes a numerical value of 1, wherein the second numerical value could then—depending on the design of housing section 1—assume a number of 2, of 3 or also of 4.

Self-loading pistols according to the prototype of a 1911 model, as well as self-loading pistols of the aforementioned Glock pistol series and also other comparable families of self-loading pistol and/or models, such as those of the companies, SIG, SIG-Sauer, Beretta, Heckler & Koch, Smith & Wesson, Walther, Ruger, Taurus, Browning and many others, are often equipped for one of the following calibers: 9 mm Luger, .357 SIG, .40 Smith & Wesson, 10 mm Auto or .45 ACP.

Such cartridges have a ratio of cartridge length to projectile caliber of less than 3.05, in some cases less than 2.65 and in some cases even less than 2.42, which is why, in deviation from a profile design shown in FIG. 6, the housing section jacket in the other figures is designed in this way that the extension of the first protrusion in X-direction is less than 4.5% of A, in particular less than 2.5% of A and quite particularly less than 1.5% of A, and/or the extension of the second protrusion in X-direction is less than 4.5% of A, in particular less than 2.5% of A and quite particularly less than 1.5% of A, wherein here the respective inside surface of the respective front and/or rear wall of the housing section and/or of the housing are formed in at least one region, optionally in all regions, free of a protrusion extending into the interior space in X-direction. The first cross-section and the second cross-section of the housing section set to one of the above ratios.

Moreover, it can be seen in the figures that a transitional region III is arranged between first region I and second region II, connecting first region I and second region II with each other.

It can therein be seen that first region I is designed to accommodate first number N1 of rows R of cartridges P in such a way that cartridges P of all rows R covered by first number N1 are to be arranged directly next to one another and optionally offset from one another in Z-direction.

Likewise, second region II is designed to accommodate second number N2 of rows R of cartridges P in such a way that cartridges P of all rows R covered by second number N2 are to be arranged directly next to one another and optionally offset from one another in Z-direction.

Intermediate region III is also designed to accommodate an intermediate number of rows R of cartridges P in such a way that cartridges P of all rows R covered by intermediate number NZ are to be arranged directly next to one another and optionally offset from one another in Z-direction.

Moreover, it can be seen in particular in FIGS. 1 and 2 that a first locking section 8 adjoins first opening cross section Q-1 in Z-direction on housing section top side 6 and/or surrounds first opening cross section Q-1 on the outside at least in X-direction and/or Y direction, wherein first locking section 8 is designed for releasable attachment to a housing 9 of a cartridge magazine 2, 10 for a portable firearm.

In addition, a locking section 11 is provided on the upper side of the housing section 6. Locking section 11 is provided for the releasable attachment of a locking element 12 shown in FIGS. 6.

It can also be seen, in particular when viewing FIGS. 1 and 2 and in conjunction with FIGS. 6*a* and 6*b*, that a second locking section 13 adjoins second opening cross-section Q-2 in Z-direction on housing section bottom side 7 and/or surrounds second opening cross-section Q-2 on the outside at least in X-direction and/or Y-direction, wherein second locking section 13 is configured for releasable attachment to a further housing section for a cartridge magazine 2, 10 for a portable firearm and/or to a base cover 14.

In the latter two FIGS. 6*a* and 6*b*, cartridge magazine 10 for a portable firearm is shown, wherein cartridge magazine 10 includes: one housing 9 for a cartridge magazine 2 and/or 10 for a portable firearm (not illustrated), defined by a housing shell 15 extending along an X-axis, a Y-axis and a Z-axis, wherein housing shell 15 has an inside housing shell surface 16 and an outside housing shell surface 17 and includes in its interior a housing interior space GIR, limited by the housing shell inside surface 16, wherein housing 9 includes a housing top side 18 and a housing bottom side 19, wherein magazine lips 19 are formed on housing top side 18, wherein the housing bottom side includes a base opening cross section Q-G, wherein a base locking section 21 adjoins the base opening cross-section Q-G in Z-direction on housing bottom side 19 and/or surrounds the base opening cross-section Q-G on the outside at least in X-direction and/or Y-direction, wherein base locking section 21 is suitable for releasable attachment of a housing section 1 for a cartridge magazine 2, 10 for a portable firearm and/or a base cover 14, 22, wherein cartridge magazine 2, 10 further includes at least one feeder 23, 24, at least one feeder spring 25, 26 and a bottom cover 22, wherein cartridge magazine 10 moreover includes a housing section 1, wherein housing section 1 is defined by a housing section shell 3, extending along an X-axis, a Y-axis, and a Z-axis, wherein housing section shell 3 has a shell inside surface 4 and a shell outside surface 5 and in its interior includes an interior space IR, limited by shell inside surface 4, and interior space IR forms at least a first region I and a second region II, wherein housing section 1 includes a housing section top side 6 and a housing section bottom side 7, wherein housing section top side 6 has a first opening cross section Q-1 and housing section bottom side 7 has a second opening cross section Q-2, wherein first region I is formed by a first cross-section Q1 for accommodating a first number N1 of rows R of cartridges P arranged next to one another and optionally offset from one another in Z-direction, and second region II is formed by a second cross-section Q2 for accommodating a second number N2 of rows R of cartridges P arranged side by side and optionally offset from each other in Z-direction, and wherein second number N2 and first number N1 differ from one another by at least one full numerical value and first cross section Q1 is consistent with first opening cross section Q-1, and wherein housing section 1 is arranged between housing 9 and bottom cover 14. Housing section 1 is herein optionally further developed according to what is described herein.

For example, it can be clearly seen from FIG. 4*d* that the at least one feeder 23, 24 is formed by a first feeder 23, wherein cartridge magazine 10 further includes a second feeder 24, and wherein first feeder 23 and second feeder 24 are designed so that first feeder 23 is at least partially movable into the space of second feeder 24, and optionally moreover, so that at least one feeder spring 25, 26 is represented by a first feeder spring 25 arranged between second feeder 24 and bottom cover 14, wherein cartridge magazine 10 further includes a second feeder spring 26 which is located between second feeder 24 and first feeder 23.

First feeder 23 is hereby arranged to be movable by a first degree of freedom F1 and a second degree of freedom F2 within the housing and/or the housing section and, in particular, within second feeder 24.

First feeder 23 is hereby arranged to pivot relative to the X-axis either from a first position L1 in which it is arranged at least partially inside second feeder 24 to a second position L2 in which it is arranged at least partially within second feeder 24, wherein the swivel angle is optionally between at least 4°, in particular at least 8°, especially between 12° and 21° to a maximum of 33°. Or, first feeder 23 is arranged to be pivotable relative to the X-axis from a first position L1 in which it is arranged at least partially inside second feeder 24 into a second position L2 in which it is arranged outside second feeder 24, wherein the pivot angle is optionally between at least 4°, in particular at least 8°, especially between 12° and 21° to a maximum of 33°.

The cartridge magazine moreover includes a locking element 12 which is illustrated in FIGS. 6*a* and 6*b*.

Locking element 12 has a first leg 27 having a first latch surface 28 and a second leg 29 having a second latch surface 30, wherein between first leg 27 and second leg 29 a connecting region 31 is provided which is connected to a blocking region 32 or forms a blocking region 32, wherein blocking region 32 has at least one contact surface 33 which is designed to accommodate a functional contact with housing 9.

Locking element 12 is designed optionally to be C-shaped.

Furthermore, at least first latch surface 28 and/or at least second latch surface 30 is designed to accommodate a functional contact with housing section 1, and in particular with at least one locking surface 34, 35 thereof.

Moreover, a distance D is provided between first leg 27 and second leg 29, in particular between first latch surface 28 and second latch surface 29, and locking element 12 is further designed in such a way that distance D is variable, in particular that it can be increased, due to the effect of an expanding force upon connecting region 31.

As already described, the conversion kit can be seen in FIGS. 6*a* and 6*b*, wherein the conversion kit includes at least:

- a housing section 1 according to what is described herein;
- one, optionally a second, feeder 23, 24;
- at least one feeder spring 25, 26;
- a bottom cover 14, suitable for closing—at least extensively—second opening cross section Q-2 of housing section 1.

In the current example, the conversion kit includes a first feeder spring 25 and a second feeder spring 26 and moreover also locking element 12.

Housing section 1 consists at least partially of plastic, for example a polyamide (PA), in particular a reinforced polyamide or a polyether-ether-ether-ketone (PEEK).

The housing section and/or the housing moreover has a window which is not illustrated and which is appropriately formed of, or covered by a, more or less, transparent, in other words clear or opaque, plastic. The window that is formed by an area made of clear or opaque plastic is manufactured in a two-component injection molding process together with the remaining area of the housing section or respectively the housing. It is thereby important that both areas are produced in the same injection mold and that the respective plastic materials, in other words the transparent plastic for the window region and in a practical sense the opaque plastic for the remaining housing section shell or the remaining housing shell, are injected into the mold consecutively, so that the plastic injected first is at least not yet completely solidified by cooling.

In connection with the illustrated and described articles, a method of converting a cartridge magazine 2, 10 for a portable firearm is disclosed, said method being characterized by the following steps:

1 provision of a housing section 1;

2 removal of bottom cover 22 of cartridge magazine 2, 10;

3 removal of the at least one feeder 23 and the at least one feeder spring 26;

4 locking of housing section 1 to a housing 9 of cartridge magazine 2, 10;

5 inserting a first feeder 23, a second feeder spring 26, a second feeder 24 and a first feeder spring 25;

6 installing bottom plate 14.

Implementation of the method will become rapidly intuitive to the expert upon consideration of FIGS. 6*a* and 6*b*, if necessary in connection with consideration of the additional figures and the description.

It is herein clear to the expert, that provision of housing section 1 in step a) by way of provision of a housing section 1 optionally according to what is described herein and/or of a conversion kit according to what is described herein is performed.

Also clear to the expert will be the requirements and obvious advantages in implementing a method of operating a portable firearm by using a cartridge magazine 2, 10, wherein a cartridge magazine 2, 10 according to what is described herein and/or a cartridge magazine 2, 10 connected to a housing portion 1 according to what is described herein is used in operating the handgun, wherein optionally in implementation of the method according to what is described herein a cartridge magazine 2, 10 produced using a (manufacturing) process according to what is described herein is used.

Component Identification Listing

I First region
II second region
III transitional region
I-G first inside region (of housing)
A distance A
B distance B
C distance C
D distance D
F1 first degree of freedom
F2 second degree of freedom
FS force, spreading force
GIR interior housing space
IR interior space
L1 first position
L2 second position
M center plane
N1 first number
N2 second number
NZ intermediate number
P cartridge(s)
Q1 first cross section
Q2 second cross section
Q-1 first opening cross section
Q-2 second opening cross section
Q-G base opening cross section (of housing)
R row(s)
Z1 rectangular zone
Z2 trapezoid zone
1 housing section
2 cartridge magazine
3 housing section shell
4 inside shell surfaces
5 outside shell surfaces
6 housing section top side
7 housing section bottom side
8 first locking section
9 housing
10 cartridge magazine
11 locking region
12 locking element
13 second locking section
14 bottom cover
15 housing shell
16 housing shell inside surface
17 housing shell outside surface
18 housing top side
19 housing bottom side
20 magazine lip(s)
21 base locking section
22 bottom cover
23 feeder, first feeder
24 feeder, second feeder
25 feeder spring, first feeder spring
26 feeder spring, second feeder spring
27 first leg
28 first latch surface
29 second leg
30 second latch surface
31 connecting region
32 blocking region
33 contact surface
34 locking surface on housing section
35 locking surface on housing section
36 first protrusion
37 second protrusion
38 groove(s)
39 additional protrusion (of first side wall)
40 additional protrusion (of second side wall)

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A housing section for a cartridge magazine for a portable firearm, the housing section comprising:

a housing section shell which extends along an X-axis, a Y-axis, and a Z-axis of the housing section and includes an inside shell surface and an outside shell surface, the housing section shell, in an interior of the housing section shell, including an interior space that is limited by the inside shell surface, the interior space forming at least a first region and a second region, the first region including a first cross section which is configured for accommodating a first number of rows of a plurality of cartridges arranged next to one another, the second region including a second cross section which is configured for accommodating a second number of rows of the plurality of cartridges arranged side-by-side, the second number and the first number differing from one another by at least one full numerical value;

a housing section top side having a first opening cross section, the first cross section being consistent with the first opening cross section;

a housing section bottom side having a second opening cross section;

a first locking section which at least one of (a) adjoins the first opening cross section in a Z-direction on the housing section top side and (b) surrounds the first opening cross section on an outside of the first opening cross section at least in at least one of an X-direction and a Y-direction, the first locking section being configured for releasably locking to a housing of the cartridge magazine for the portable firearm, wherein the housing section lacks a plurality of magazine lips and thus is not configured for independently storing a plurality of cartridges.

2. The housing section according to claim 1, wherein the interior space forms a transitional region between the first region and the second region, the transitional region connecting the first region and the second region with each other.

3. The housing section according to claim 2, wherein the first region is configured for accommodating the first number of rows of the plurality of cartridges in such a way that the plurality of cartridges of all the rows covered by the first number are to be arranged directly adjacent to one another and offset from one another in a Z-direction.

4. The housing section according to claim 2, wherein the second region is configured for accommodating the second number of rows of the plurality of cartridges in such a way that the plurality of cartridges of all the rows covered by the second number are to be arranged directly adjacent to one another and offset from one another in a Z-direction.

5. The housing section according to claim 2, wherein the transitional region is configured for accommodating an intermediate number of rows of the plurality of cartridges in such a way that the plurality of cartridges of all the rows covered by the intermediate number are to be arranged directly next to one another and offset relative to one another in a Z-direction.

6. The housing section according to claim 1, further comprising a locking region provided on the housing section top side.

7. The housing section according to claim 6, further comprising a locking element, wherein the locking region is provided for releasable securement of the locking element.

8. The housing section according to claim 1, further comprising a second locking section which at least one of (a) adjoins the second opening cross section in the Z-direction on the housing section bottom side, and (b) surrounds the second opening cross section at least in at least one of the X-direction and the Y-direction on an outside of the second opening cross section, wherein the second locking section is configured for releasably locking at least one of to a further housing section for the cartridge magazine for the portable firearm and on a base cover of the cartridge magazine.

9. The housing section according to claim 1, wherein the housing section is configured for being connected to the cartridge magazine which is configured for being used with the portable firearm which is configured for being operated using the cartridge magazine.

10. A cartridge magazine for a portable firearm, the cartridge magazine comprising:

a housing including a housing shell extending along an X-axis, a Y-axis, and a Z-axis of the cartridge magazine, the housing shell including a housing shell inside surface and a housing shell outside surface, the housing shell, in an interior of the housing shell, including a housing interior space that is limited by the housing shell inside surface, the housing interior space forming at least a first inside region;

a housing top side;

a housing bottom side including a base opening cross section;

a plurality of magazine lips on the housing top side;

a base locking section, which at least one of adjoins the base opening cross-section in a Z-direction on the housing bottom side and surrounds the base opening cross-section at least in at least one of an X-direction and a Y-direction at least on an outside of the base opening cross section;

at least one feeder;

at least one feeder spring;

a first base cover;

a second base cover;

a housing section including:

a housing section shell which extends along the X-axis, the Y-axis, and the Z-axis of the housing section and includes an inside shell surface and an outside shell surface, the housing section shell, in an interior of the housing section shell, including an interior space that is limited by the inside shell surface, the interior space forming at least a first region and a second region, the first region including a first cross section which is configured for accommodating a first number of rows of a plurality of cartridges arranged next to one another, the second region including a second cross section which is configured for accommodating a second number of rows of the plurality of cartridges arranged side-by-side, the second number and the first number differing from one another by at least one full numerical value;

a housing section top side having a first opening cross section, the first cross section being consistent with the first opening cross section; and a housing section bottom side having a second opening cross section; and a first locking section which at least one of (a) adjoins the first opening cross section in a Z-direction on the housing section top side and (b) surrounds the first opening cross section on an outside of the first opening cross section at least in at least one of an X-direction and a Y-direction, the first locking section being configured for releasably locking to a housing of the cartridge magazine for the portable firearm, wherein the housing section lacks a plurality of magazine lips and thus is not configured for independently storing a plurality of cartridges, wherein the base locking section is configured for releasably locking at least one of (a) the housing section and (b) at least one of (i) the first base cover and (ii) the second base cover, wherein the housing section is arranged between the housing and the first base cover.

11. The cartridge magazine according to claim 10, wherein the interior space forms a transitional region between the first region and the second region, the transitional region connecting the first region and the second region with each other.

12. The cartridge magazine according to claim 10, wherein the at least one feeder is a first feeder, the cartridge magazine further comprising a second feeder, the first feeder and the second feeder being configured such that the first feeder is movable, at least partially, into a space of the second feeder, the at least one feeder spring being a first feeder spring arranged between the second feeder and the first base cover, the cartridge magazine further comprising a second feeder spring which is arranged between the second feeder and the first feeder.

13. The cartridge magazine according to claim 12, wherein the first feeder is arranged to be movable by a first degree of freedom and a second degree of freedom within at least one of the housing and the housing section and within the second feeder.

14. The cartridge magazine according to claim 12, further comprising a locking element.

15. The cartridge magazine according to claim 10, wherein the cartridge magazine is configured for being used with the portable firearm which is configured for being operated using the cartridge magazine.

* * * * *